US006904705B2

(12) United States Patent
Polegato Moretti

(10) Patent No.: US 6,904,705 B2
(45) Date of Patent: Jun. 14, 2005

(54) SHOE WITH PERMEABLE AND BREATHABLE UPPER THAT COVERS AT LEAST PARTIALLY AN IMPERMEABLE SOLE THAT IS RENDERED BREATHABLE

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 163 days.

(21) Appl. No.: 10/455,428

(22) Filed: Jun. 6, 2003

(65) Prior Publication Data

US 2004/0006888 A1 Jan. 15, 2004

(30) Foreign Application Priority Data

Jun. 6, 2002 (IT) ..... PD2002A0153

(51) Int. Cl.[7] ..... A43B 3/14; A43B 13/12

(52) U.S. Cl. ..... 36/11; 36/3 R; 36/3 B; 36/12; 36/30 R

(58) Field of Search ..... 36/9 R, 11, 3 R, 36/313, 4, 12, 14, 59 R, 59 C, 59 A, 30 R

(56) References Cited

U.S. PATENT DOCUMENTS 429,429 A 6/1890 Eckhardt
1,196,671 A * 8/1916 Emmons ..... 36/9 R
1,597,934 A * 8/1926 Stimpson ..... 36/3 A
D206,222 S * 11/1966 Mostile ..... D2/924
5,077,916 A * 1/1992 Beneteau ..... 361/114
5,515,566 A 5/1996 Ganon
5,746,012 A * 5/1998 Caletti et al. ..... 36/3 B
5,983,524 A 11/1999 Polegato
6,389,711 B1 5/2002 Polegato
6,604,302 B2 8/2003 Polegato Moretti
2001/0010127 A1 8/2001 Polegato Moretti

* cited by examiner

*Primary Examiner*—M. D. Patterson
(74) *Attorney, Agent, or Firm*—Oblon, Spivak, McClelland, Maier & Neustadt, P.C.

(57) ABSTRACT

A shoe with permeable/breathable upper that covers, at least partially, an impermeable breathable sole, comprising a sole layer made of rubber connected internally to a wraparound upper made of synthetic or natural leather, the sole layer having nubs that pass through holes of the upper to constitute a tread, at least some of the nubs having at least one through hole, a breathable or perforated protective layer, a membrane permeable to vapor and impermeable to water and a breathable or perforated insole or anatomical inner sole being arranged in succession from below, at least at the holes of the nubs, above the sole layer, the protective layer and the membrane having edges substantially adjacent and joined hermetically to the sole layer and to the inner sole.

16 Claims, 4 Drawing Sheets

SHOE WITH PERMEABLE AND BREATHABLE UPPER THAT COVERS AT LEAST PARTIALLY AN IMPERMEABLE SOLE THAT IS RENDERED BREATHABLE

BACKGROUND OF THE INVENTION

The present invention relates to a shoe in which the upper, of the permeable and breathable type such as natural leather, covers at least partially a sole that is impermeable because it is made of rubber or another elastomer and is rendered breathable.

Special shoes known as "driving moccasins", which are manufactured by arranging, inside the wraparound leather upper, a layer of rubber with nubs that pass through suitable holes of the upper are more and more successful on the market.

The nubs constitute tread elements for resting on the ground.

Such rubber layer is sewn onto the leather of the upper before it is closed onto an upper tongue, which corresponds to the front part of the foot, with a hand-stitched seam.

A cleaning insole is applied internally over the rubber layer.

This provides a shoe that is highly flexible and adapts to the anatomy of the foot, increasing its sensitivity, which is critical for example while driving.

For this purpose, the rubber layer rises behind the heel so as to extend over the heel also with the through nubs, whereby to allow the heel to rest on a surface, while driving, without spoiling the leather.

The main problems that limit the use of shoes of this type are due mainly to the lack of moisture permeation caused by the layer of rubber that is interposed between the leather of the upper and the foot and to the lack of waterproofness caused by the immediate absorption of water which, through the stitched seams that pierce the rubber layer, immediately wets the cleaning insole and therefore the foot.

SUMMARY OF THE INVENTION

The aim of the present invention is to provide a shoe of the "driving moccasin" type that eliminates both of the drawbacks noted above in the background art, being at the same time breathable through the part below the sole of the foot and impermeable to water at least in the same region.

A consequent primary object is to provide a shoe that has substantially the same characteristics of grip on the ground in all conditions of use as known shoes of the "driving moccasin" type.

Another object is to increase user comfort.

Another object is to provide a shoe of the "driving moccasin" type that can be manufactured at a low cost and therefore sold at a competitive price.

Another object is to provide a shoe of the "driving moccasin" type that can be manufactured with conventional equipment and methods.

This aim and these and other objects that will become better apparent hereinafter are achieved by a shoe with a permeable and breathable upper that covers at least partially an impermeable sole that is rendered breathable, characterized in that it comprises a sole layer that is made of rubber or of another elastomer connected internally to a wraparound upper made of leather or similar material, said sole layer made of rubber or similar material having nubs that pass through suitable holes of the upper and constitute as a whole the tread, at least some of said nubs having at least one through hole, a breathable or perforated protective layer, a membrane that is permeable to vapor and impermeable to water and a breathable or perforated insole or anatomical inner sole being arranged in succession from below, at least at said holes of said nubs, above said sole layer made of rubber or other elastomer, said protective layer and said membrane having edges that are substantially adjacent and joined hermetically to said sole layer made of rubber or other elastomer and to said inner sole.

BRIEF DESCRIPTION OF THE DRAWINGS

Further characteristics and advantages of the invention will become better apparent from the detailed description of an embodiment thereof, illustrated by way of non-limitative example in the accompanying drawings, wherein.

DESCRIPTION OF THE PREFERRED EMBODIMENTS

Figure 1:
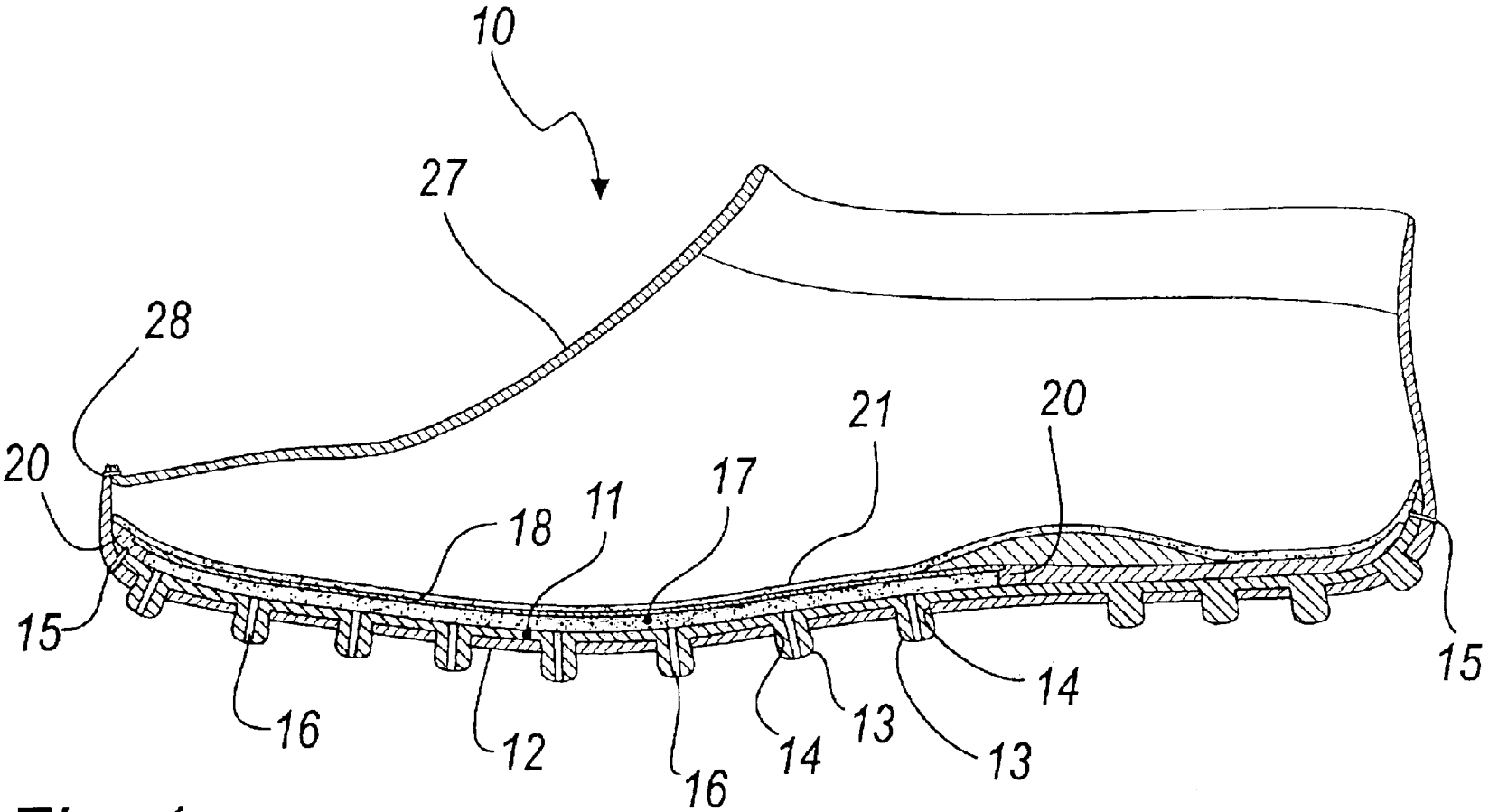
FIG. 1 is a longitudinal sectional view of a shoe according to the invention.
Figure 2:
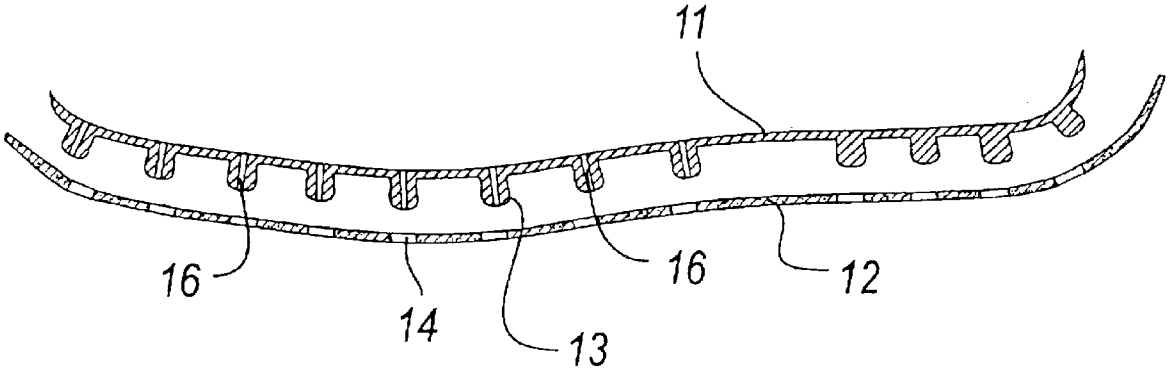
FIG. 2 is an exploded view of two components of the shoe of FIG. 1.
Figure 3:
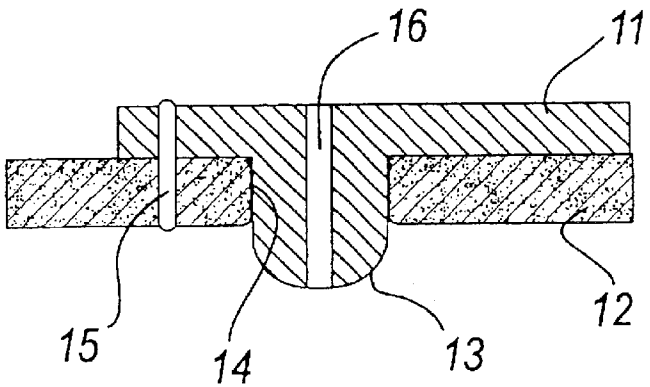
FIG. 3 is an enlarged-scale view of the two components of FIG. 2 in the assembled condition.
Figure 4:
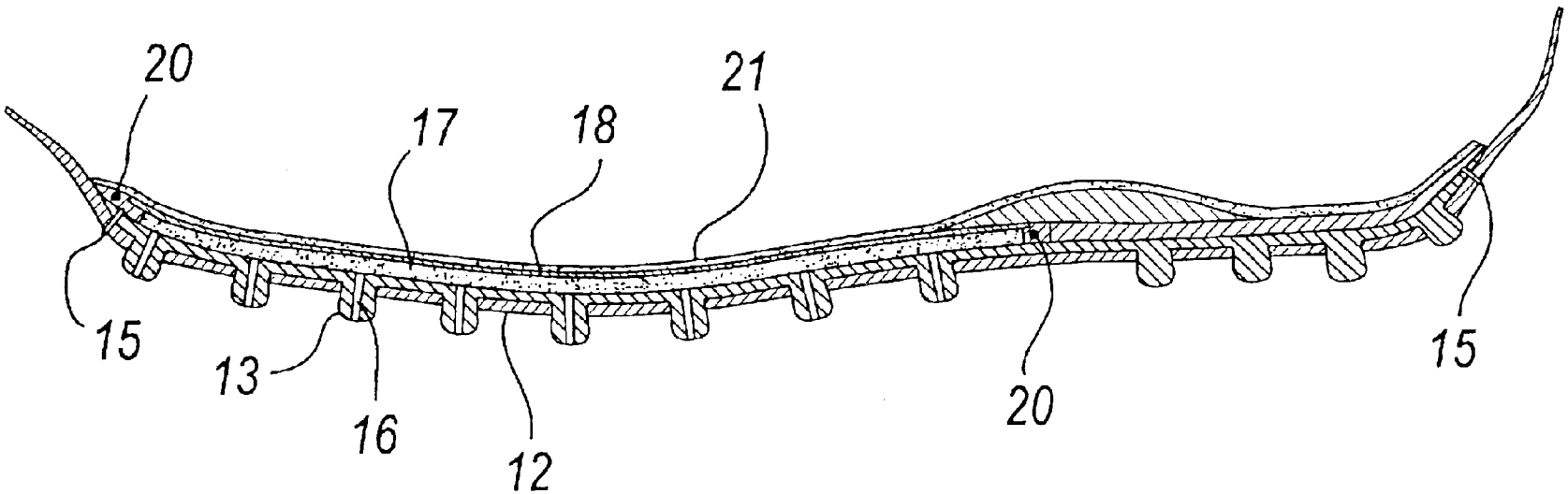
FIG. 4 is a sectional view of the components of the shoe of FIG. 1 prior to final assembly.

With reference to the figures, a shoe of the "driving moccasin" type is generally designated by the reference numeral 10 and comprises a sole layer 11 made of rubber or other elastomer, which is arranged inside a wraparound upper 12 made of leather.

The sole layer 11 has nubs 13 that pass through suitable holes 14 of the upper 12.

The nubs 13 constitute tread elements for resting on the ground.

The sole layer 11 made of rubber is connected along a flat surface, by means of adhesive and/or stitched seams 15, to the leather of the upper 12.

At least some of said nubs 13 have at least one through hole 16 which, as will become better apparent hereinafter, allows the exchange of water vapor with the inside of the shoe 10.

A protective (filler) layer 17 and a membrane 18 that is permeable to vapor and impermeable to water are arranged above the rubber sole layer 11, particularly at the holes 16, in succession from below; said layer and said membrane have substantially adjacent and overlapping edges that are joined sealingly by a peripheral element 20 made of a plastic material such as TPU (thermoplastic polyurethane) or TR (thermoplastic rubber) or PU (polyurethane), which is molded or glued or heat-sealed so as to also seal the stitched seams 15.

In an upward region there is an anatomical inner sole or insole 21, which is breathable or perforated and is molded or spot-glued.

The membrane 18 is preferably made of a material such as the one commonly known as Gore-Tex™.

The protective layer 17 is made of perforated or breathable material, such as hydrophilic felt, gelling rubber such as DRYZ™ provided by DICON TECHNOLOGIES, open-cell rubbers.

The peripheral element 20 can be sealed perimetrically to the sole layer 11 and externally to the stitched seams 15 by non-soluble and permanent gluing or by way of other known methods (high frequency, direct injection molding, etc).

As an alternative, the peripheral element 20 can be obtained by injection-molding in a mold 22 (composed of a lower mold part 23 and an upper mold part 24), in which the inner sole 21 is inserted as an insert and is coupled in discrete points, or only perimetrically, to the membrane 18, which is in turn coupled to the protective layer 17, made thinner at a perimetric region thereof so that the plastic material of the subsequent injection of plastic material that forms the perimetric sealing element 20 is able to bond with the membrane 18 and the inner sole 21 in order to seal them against water, optionally with the aid of suitable adhesives.

Figure 5:
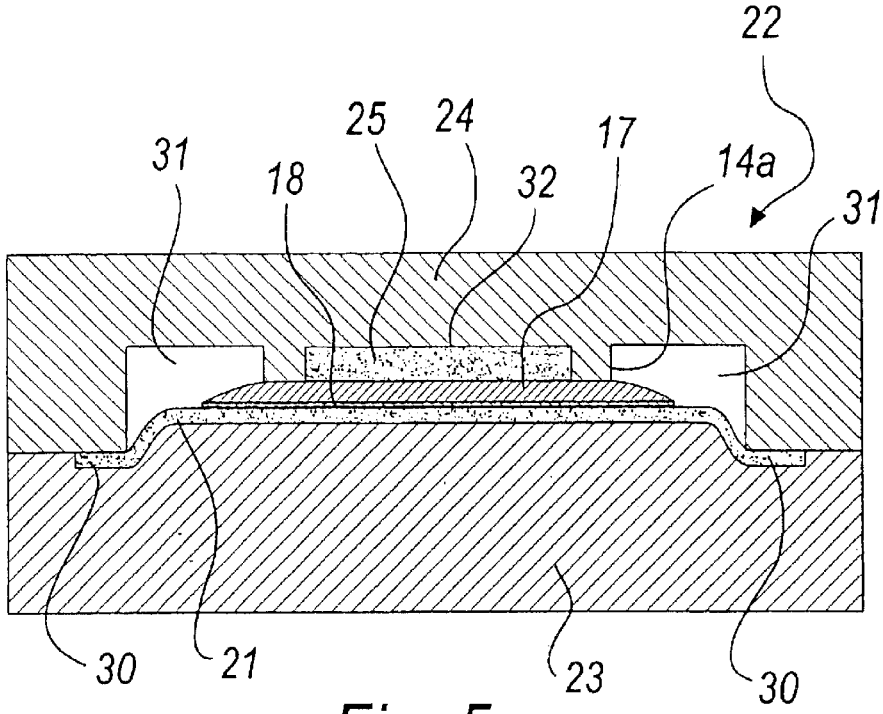
FIG. 5 is a sectional view of a mold that can be used to assemble components of the shoe according to the invention.
Figure 6:
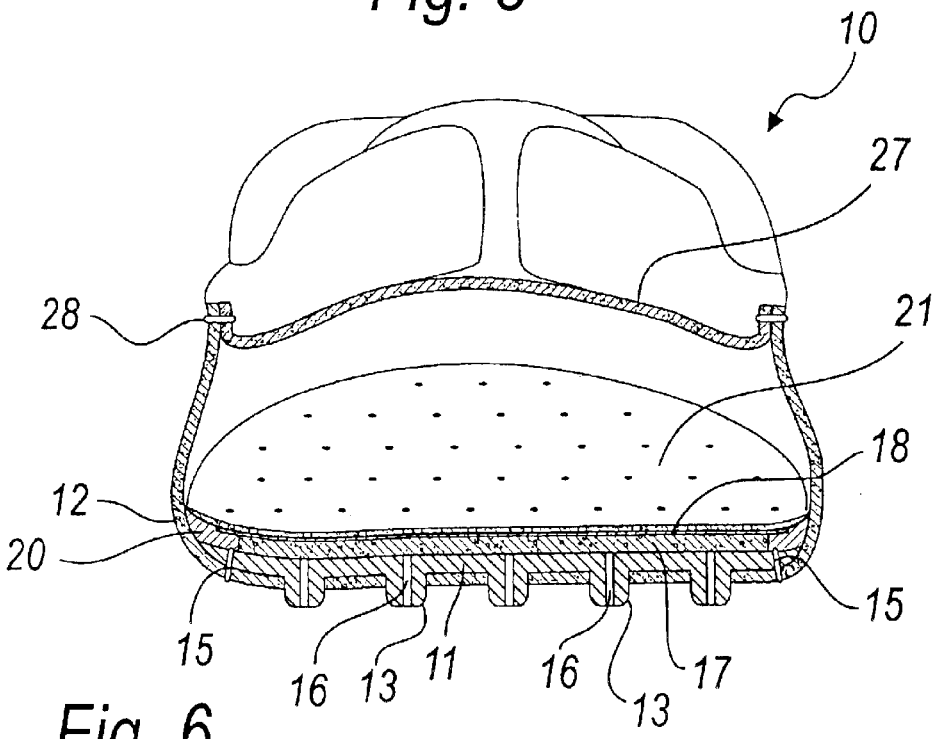
FIG. 6 is a transverse sectional view of the shoe of FIG. 1.

As shown in FIG. 5, the inner sole 21 is retained with the edges 30 between the mold parts 23 and 24, while in the upper mold part 24 a seat 31 is provided for the injection-molding of said peripheral element 20 and the flash trimmers 24*a* that leave a central clear area 32.

In the central portion, at the pronation region, it is possible to insert in the mold 22 (in the free region 32 between the flash trimmers 24*a*), a breathable or absorbent filler layer 25 (hydrophilic felt, gelling rubber such as DRYZ, open-cell rubbers or perforated layers, et cetera).

The layer 25 can also be applied after the molding of the peripheral element 20.

The upper 12 is sealed with the peripheral element 20 and with the sole layer 11, so that the connecting stitched seams 15 cannot convey water into the inner sole 21.

The holes 16 are therefore connected to the inside of the shoe 10, as regards vapor permeability, through the breathable layer 17, the membrane 18, the optional breathable layer 25, and the breathable and/or perforated inner sole 21.

The peripheral element 20 can be glued along its outer edges 26 to the upper 12 so as to slow the water absorption of the upper 12.

Water, in order to wet the foot, would have to rise beyond the edges 26 of the peripheral element 20, taking a very long time and in any case keeping the inner sole 21 dry.

The sealing of the membrane 18 by way of the peripheral element 20 can be obtained also by coupling such membrane to meshes or nets (not shown in the figures), instead of the protective layer 17, which ensure the penetration of the perimetric sealing plastic material.

As an alternative, the perimeter region of the membrane 18 can be left unprotected so that the plastic of the peripheral element 20 adheres to it directly.

The shoe 10 is completed by surrounding the edges of an upper tongue 27 with the edges of the upper 12 and by joining them with a hand-stitched seam 28.

In practice it has been found that the intended aim and objects of the present invention have been achieved.

A shoe of the "driving moccasin" type has in fact been provided which is simultaneously breathable through the part that lies under the sole of the foot and impermeable to water at least in the same region, and this helps to increase user comfort.

The shoe substantially has the same ground grip characteristics in all conditions of use as known shoes of the "driving moccasin" type, and in relation to this characteristic it is merely provided with the addition of the holes 16.

The shoe can be manufactured with conventional equipment and techniques and can also be manufactured at a low cost and therefore sold at a competitive price.

The invention thus conceived is susceptible of numerous modifications and variations, all of which are within the scope of the appended claims.

All the details may further be replaced with other technically equivalent elements.

In practice, the materials used, so long as they are compatible with the contingent use, as well as the dimensions, may be any according to requirements.

The disclosures in Italian Patent Application No. PD2002A000153 from which this application claims priority are incorporated herein by reference.

What is claimed is:

1. A shoe with a permeable and breathable upper that covers, at least partially, an impermeable breathable sole, comprising: a wraparound upper made of natural leather or synthetic leather; a sole layer that is made of rubber or elastomer and connected internally to said upper; nubs, provided at said sole layer, that pass through holes provided in said upper, said nubs constituting, as a whole, a tread, with at least some of said nubs having at least one through hole; a protective layer that is provided breathable or perforated; a membrane that is permeable to vapor and impermeable to water; a breathable or perforated insole; or anatomical inner sole, said protective layer, membrane, insole and inner sole being arranged in succession from a lower part to an upper part of the shoe, and at least at said holes of said nubs, above said sole layer and wherein said protective layer and said membrane have edges thereof that are substantially adjacent and joined hermetically to said sole layer and to said inner sole to form a hermetic coupling.

2. The shoe of claim 1, wherein said sole layer made of rubber or elastomer is joined by means of adhesive and/or stitched seams to said upper, the hermetic coupling comprising said stitched seams.

3. The shoe of claim 2, further comprising a perimetric element, said protective layer and said membrane that is permeable to vapor and impermeable to water being joined hermetically by said perimetric element made of plastics, which is molded so as to also seal said stitched seams.

4. The shoe of claim 3, wherein said perimetric element is injection-molded in a mold onto said inner sole or on said breathable or on said perforated insole, said inner sole being coupled at discrete points over a surface of, or only perimetrically to said membrane, said membrane being in turn coupled to said protective layer.

5. The shoe of claim 4, wherein said membrane is provided free of protection, with said perimetric element adhering thereto directly.

6. The shoe of claim 4, wherein said protective layer has a thinner perimeter region so that a plastic material that forms said perimetric sealing element is glued to said membrane and to said inner sole, or to said breathable or perforated insole, in order to seal said membrane, inner sole and insole against water.

7. The shoe of claim 6, wherein said sealing element is glued with sealing adhesives.

8. The shoe of claim 3, further comprising a breathable or absorbent filler layer inserted in a central part of, and below said inner sole and above said membrane, at a pronation region of the shoe.

9. The shoe of claim 8, wherein said filler layer is made of a hydrophilic felt, a gelling rubber, an open-cell rubber, or from perforated plastics layers.

10. The shoe of claim 8, wherein said filler layer is applied on, or is glued to the inner sole or breathable or perforated insole, so as to constitute a monolithic assembly.

11. The shoe of claim 3, wherein said perimetric element is glued along outer edges thereof to said upper so as to slow water absorption of said upper.

12. The shoe of claim 3, wherein said protective layer is made of a hydrophilic felt, gelling rubber, open-cell rubbers, or perforated synthetic or natural material.

13. The shoe of claim 3, wherein said protective layer is constituted by a net or mesh element.

14. The shoe of claim 2, further comprising a perimetric element, said protective layer and said membrane that is permeable to vapor and impermeable to water being joined hermetically by said perimetric element made of plastics, which is glued thereto so as to also seal said stitched seams.

15. The shoe of claim 2, further comprising a perimetric element, said protective layer and said membrane that is permeable to vapor and impermeable to water being joined hermetically by said perimetric element made of plastic material, which is heat-sealed thereto so as to also seal said stitched seams.

16. The shoe of claim 1, wherein said anatomical inner sole, said breathable or said perforated insole, is molded or spot-glued onto the sole layer.

* * * * *